US005622295A

United States Patent [19]

Hellweg et al.

[11] Patent Number: 5,622,295

[45] **Date of Patent: *Apr. 22, 1997**

[54] HOLSTER FOR HANDGUNS OR THE LIKE

[76] Inventors: Albert W. Hellweg, 84 Terrara Road, Vermont, Victoria, 3133, Australia; Kerby C. Smith, 42827 Bean Gulch Ranch Rd., Coarsegold, Calif. 93614

[ * ] Notice: The term of this patent shall not extend beyond the expiration date of Pat. No. 5,419,472.

[21] Appl. No.: 486,315

[22] Filed: Jun. 7, 1995

Related U.S. Application Data

[63] Continuation-in-part of Ser. No. 187,842, Jan. 28, 1994, Pat. No. 5,419,472.

[51] Int. Cl.[6] ..... F41C 33/00

[52] U.S. Cl. ..... 224/193; 224/911; 224/912; 224/243

[58] Field of Search ..... 224/911, 912, 224/192, 193, 194, 195, 197, 198, 252, 253, 269, 270, 271, 234, 243

[56] References Cited

U.S. PATENT DOCUMENTS

| | | | |
|---|---|---|---|
| 1,629,700 | 5/1927 | Harter | 224/911 |
| 2,001,321 | 5/1935 | Berns | 224/193 |
| 3,252,639 | 5/1966 | Sloan | 224/243 |
| 3,923,214 | 12/1975 | Kipper | 224/911 |
| 4,205,768 | 6/1980 | Hill et al. | 224/193 |
| 4,303,185 | 12/1981 | Shoemaker | 224/193 |
| 4,485,947 | 12/1984 | Cook | 224/911 |
| 5,150,825 | 9/1992 | Nichols | 224/911 |
| 5,269,448 | 12/1993 | Shoemaker | 224/243 |
| 5,282,559 | 2/1994 | Wisser et al. | 224/243 |
| 5,419,472 | 5/1995 | Hellweg et al. | 224/911 |

*Primary Examiner*—Henry J. Recla
*Assistant Examiner*—Gregory M. Vidovich
*Attorney, Agent, or Firm*—Calfee Halter & Griswold

[57] ABSTRACT

A holster for a handgun comprising a holster body for receiving the handgun, the holster body being mounted on a belt receiving member; the holster body having an open top for receiving the handgun, and an open bottom to allow a barrel of the handgun to project therethrough if required; the holster body is of a folded construction having two substantially parallel but spaced apart ends shaped to conform with the barrel and/or slide of the handgun to define an open side therebetween, there being provided at least one adjustable tension means passing between the ends and across the open side to retain the ends in a desired but adjustable spaced relationship.

6 Claims, 2 Drawing Sheets

HOLSTER FOR HANDGUNS OR THE LIKE

RELATED APPLICATIONS

This application is a continuation-in-part of U.S. application Ser. No. 08/187,842, filed Jan. 28, 1994, now U.S. Pat. No. 5,419,472.

FIELD OF THE INVENTION

This invention relates in general,to a holster for guns or the like and, more particularly, to adjustable holsters for handguns or the like.

BACKGROUND OF THE INVENTION

Throughout this specification reference to "guns" is to include reference to handguns and other related products. Although a holster for handguns is described, it will be realized that the present invention could be used in relation to many other products which are used in related fields such as, for example, holsters or ammunition containers for magazines or speed loaders and the like.

There have been numerous prior art holster designs which have eliminated retention straps and/or flaps to hold the handgun in the holster. Some of those designs have been described and illustrated in U.S. Pat. Nos. 3,420,420, 3,923,214, 4,205,768, 4,925,075 and 5,167,355. Of particular interest are those holster designs which use reinforced holster bodies to place tension on the handgun such as Kippen (U.S. Pat. No. 3,923,214) and Hill (U.S. Pat. No. 4,205,768). What these designs have in common (Kippen and Hill) is that the body of the holster wraps around the top of the handgun, specifically the barrel and/or slide of the handgun. If they place tension on the handgun they do so by applying it to the body of the firearm. Kippen specifically applies pressure to the cylinder of revolvers and it is unlikely that the design would retain a flat sided autoloading pistol. While Hill addresses "pistols of the clip-fed .45 caliber type hand guns" and the Hill design uses a holster body or "boot" with "skirts" which exert "a clamping force upon the barrel of the side arm" it still wraps over the top of barrel and is adjusted underneath the frame of the handgun. This design provides for a large bulky holster.

There also have been designs which have wrapped the holster body underneath the handgun such as Rogers (U.S. Pat. No. 4,925,075) and Hill (U.S. Pat. No. 5,167,355) but these holsters use mechanical devices to retain the handgun in the holster.

It is therefore the principal object of the present invention to provide a holster which minimizes the bulk of the holster and does not require a mechanical restraint to hold the handgun in the holster.

A further object of the invention is to provide a holster which has a spring like reinforcement, which combined with the unique shape of the holster applies tension to the handgun barrel and/or slide and allows the user to easily adjust the amount of tension on the handgun with a spaced retention device.

SUMMARY OF THE INVENTION

With the above and other objects in mind the present invention provides a holster for a handgun comprising a holster body for receiving said handgun, said holster body adapted to be mounted on a belt receiving member; said holster body having an open top for receiving said handgun, and an open bottom to allow a slide and/or barrel of said handgun to project therethrough, if required; said holster body being of a folded construction molded around the frame and/or slide and/or barrel of the handgun and having two bends which terminate in two substantially parallel but spaced apart ends defining an open side therebetween, said holster body being formed from a surface material surrounding a reinforcing, said reinforcing providing a spring like pressure force between said spaced apart ends, there being provided at least one adjustable tension device passing between said ends and across said open side to retain said ends in a desired but adjustable spaced relationship whereby said spaced apart ends provide pressure on the handgun at the bends when said handgun is inserted in said holster.

BRIEF DESCRIPTION OF THE DRAWINGS

In order that the invention may be fully understood, there shall now be described by way of non-limitative example only preferred constructions of a holster for guns (as hereinbefore defined) incorporating the principle features of the present invention, the description being with reference to the accompanying illustrative drawings in which.

DETAILED DESCRIPTION

Figure 1:
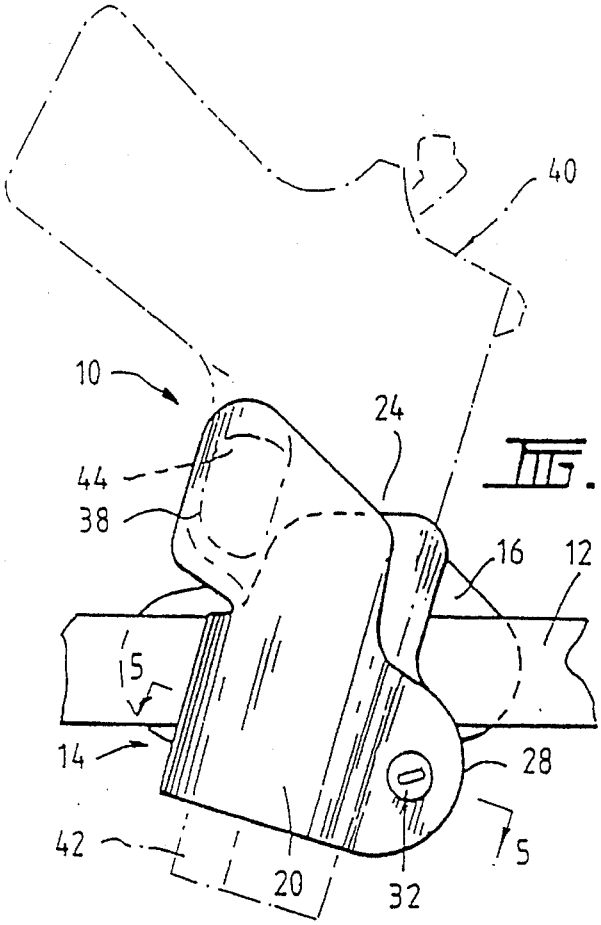
FIG. 1 is a side view of a first embodiment of a holster.
Figure 2:
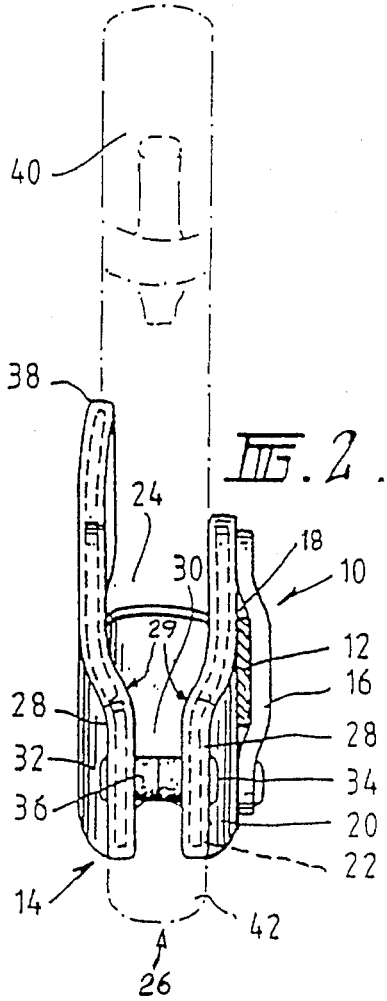
FIG. 2 is a front view of the holster shown in FIG. 1.
Figure 3:
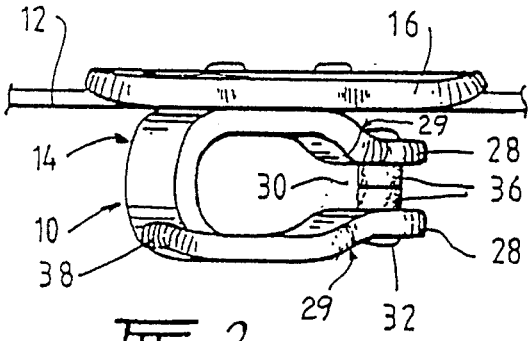
FIG. 3 is a top-plan view of the holster of FIGS. 1 and 2.
Figure 4:
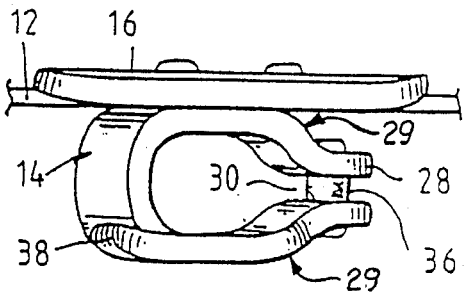
FIG. 4 is a top-plan view of the holster of FIG. 3 after the spaced tensioning device has been adjusted.

As shown in FIGS. 1 to 6 there is shown a holster generally designated as 10 which is mounted on a belt 12. The holster 10 comprises a pouch or holster body 14 which is mounted on a belt-receiving member 16 with the belt 12 passing through a gap 18 so as to retain the holster 10 on the belt 12.

Figure 6:
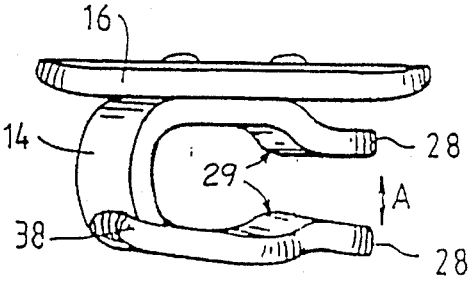
FIG. 6 is a similar view to that of FIG. 4 without the spaced tensioning device.

The holster body 14 is generally made as a folded construction and comprises a surface material 20 surrounding a reinforcing 22. It is preferable that the reinforcing 22 be a material such as, for example, aluminum, fibreglass or steel—a material which can be molded or pressed to the required shape. Reinforcing 22 is a spring like material and will provide tension when parallel spaced apart ends 28 are moved towards and away from one another as shown in FIG. 6. The surface material 20 can be any suitable material such as, for example, a nylon, vinyl or leather.

Figure 5:
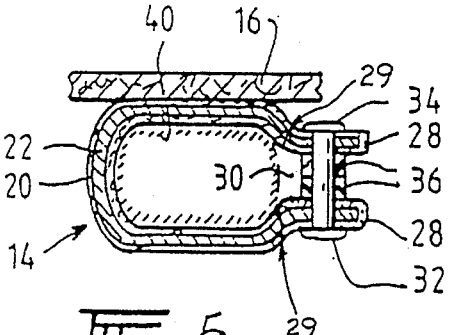
FIG. 5 is a cross-sectional view along and in the direction of arrows 5—5 shown in FIG. 1.

As can be seen, the holster body 14 has a top 24 which is open and an open bottom 26 which allows the barrel or slide 42 of handgun 40 to project therethrough, if required. Naturally, the holster body 14 is shaped appropriately for the handgun 40 to be contained therein. However, with the bottom 26 being open fully no matter the length of the barrel or slide 42 of handgun 40, it can still be accommodated—providing the general shape of handgun 40 matches the general shape of the holster body 14. FIG. 5 shows holster body 40 with its two opposing sides following the curves of barrel and/or slide 42 to provide the proper fit therefor. The inward curving or bending 29 of the pouch on opposite sides adjacent ends 28 allows contact to be made with barrel and/or slide 42 and prevents handgun 40 from rocking in holster 10. The curving or bending 29 also prevents the handgun from falling out of the front of holster 10. To prevent premature triggering of handgun 40 a flap 38 is provided which covers the trigger 44 and trigger guard of handgun 40.

Being a folded construction, there are two ends or offset wings 28 of the opposing sides of holster body 14 which define therebetween an open side 30 at the front of holster 10. The open side 30 provides a natural open area or sight track which allows handgun 40 to be drawn without the front sight contacting holster 10. As there is nothing at the front there is nothing for the front sight to hang up on in drawing handgun 40. Extending across the open side 30 is a bolt 32 which cooperates with a captive nut 34. Mounted over the bolt 32 are optional spacers or tubes 36, As is clear from FIG. 3, there may be two such spacers or tubes. Spacers 36 protect the screwthread of bolt 32 and are normally formed from rubber. However, as is clear from FIG. 4, by adjusting the bolt, and even removing the bolt 32 and altering the number of spacers 36, upon the re-tightening of the bolt, the gap between the ends 28 and thus the width of the open side 30 can be varied which will either compress spacer 36 or allow it freeplay. In this way, the user of the holster can adjust the pressure being exerted upon the gun to increase or decrease that pressure on the opposing sides of holster body 14 at bends 29 so that the ease of insertion or removal of the handgun can be varied; and also the slight variations in size of the handgun adjusted for. The bolt 32 and nut 34 draw the spring like holster body 14 together to provide a clamping pressure on the frame and slide and/or barrel of handgun 40. Ends or offset wings 28 extend in front of handgun 40. This pressure can be easily and precisely adjusted over a wide range to suit the user. As shown in FIG. 6 if bolt 32 and nut 34 were not provided holster body 14 would spring open and place no pressure on gun 40. Spacers or tubes 36 are optional as the holster will operate without them.

As can be seen from the foregoing description, the holster 10 permits relatively easy access of the handgun to the holster body 14 and by having a fully open bottom 26, different barrel lengths of the same type of handgun can be accommodated. By having the adjustment of the spaced tension device comprising bends 29 and the bolt 32 cooperating with the nut 34, handguns of the same type but of slightly different size can be accommodated in the same holster body 14, and an individual can vary the pressure to accommodate their own desires.

Figure 7:
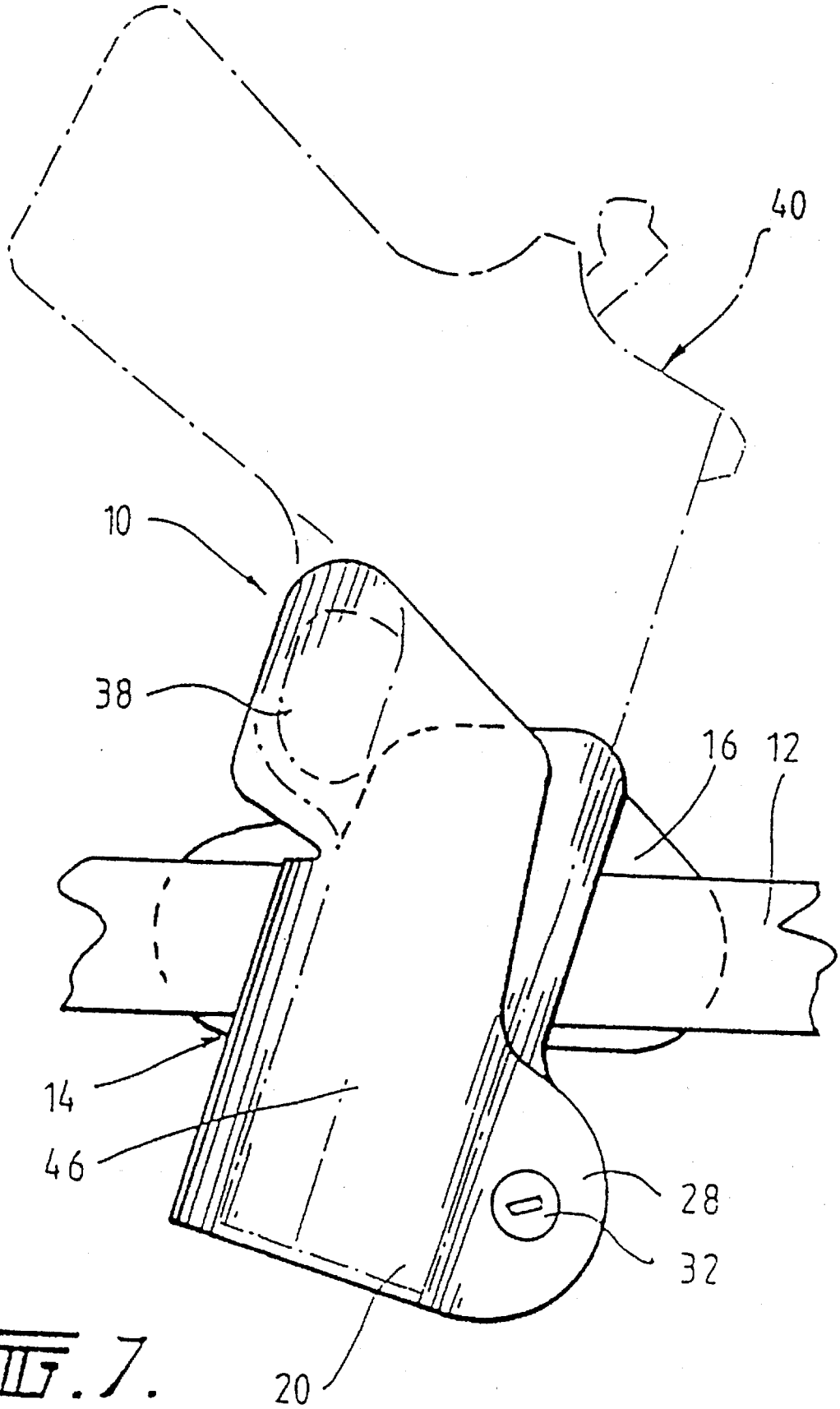
FIG. 7 is a second embodiment of a holster.

FIG. 7 illustrates a second embodiment of the invention. The same reference numerals have been retained as used with references to FIGS. 1 to 6. The difference in this embodiment is that the length of holster 46 has been increased to cover the entire barrel and/or slide 42 of handgun 40.

Whilst there has been described in the foregoing description preferred constructions of a holster for guns (as hereinbefore defined) it will be understood by those skilled in the art that many variations or modifications in details of design or construction can be made without departing from the principle features of the present invention.

We claim:

1. A holster for a handgun, the handgun having a handle, a trigger and a barrel extending from the handle, the barrel having an underside facing the handle, an upper side facing away from the handle and an end portion terminating in a muzzle end, said holster comprising:

a holster body configured to wrap around the underside of the barrel of the gun and terminating in opposing end portions both extending beyond the upper side of the barrel thereby defining an open top and an open bottom wherein the holster body is sized such that the muzzle end of the gun is capable of projecting through said open bottom and the handle extends above said open top when the gun is fully inserted into said holster, each of said end portions of said holster body having a bend such that each of said end portions terminate in substantially parallel but spaced apart ends spaced from the upper side of the barrel and defining an open side therebetween, said holster body being formed from a surface material surrounding a reinforcing, said reinforcing providing a spring-like pressure force between said spaced apart ends, there being provided at least one adjustable tension device passing between said spaced apart ends and across said open side to retain said spaced apart ends in a spaced relationship whereby said end portions provide pressure on the handgun when the handgun is fully inserted into said holster.

2. The holster as claimed in claim 1, wherein said at least one adjustable tension device is a bolt passing through one of said spaced apart ends and co-operating with a captive nut at the other of said spaced apart ends, said bolt including at least one compressible spacer therearound between said spaced apart ends.

3. The holster as claimed in claim 1, wherein said holster has a flap which cover the trigger of the handgun fully inserted into said holster.

4. The holster as claimed in claim 1, wherein said open side is at the front of said holster.

5. The holster as claimed in claim 1, wherein said bends are adapted to contact the upper side of the barrel to prevent the handgun from rocking within the holster.

6. The holster as claimed in claim 1, wherein said surface material is a relatively soft material.

* * * * *